US006189474B1

(12) United States Patent
Stewart

(10) Patent No.: US 6,189,474 B1
(45) Date of Patent: Feb. 20, 2001

(54) SELF-CONTAINED SHIP'S HOLD CARGO RECOVERY AND CLEANING VESSEL AND METHOD

(75) Inventor: William Stewart, 311 W. 100th St., Apartment 2, New York, NY (US) 10025

(73) Assignee: William Stewart, New York, NY (US)

( * ) Notice: Under 35 U.S.C. 154(b), the term of this patent shall be extended for 0 days.

(21) Appl. No.: 09/363,627

(22) Filed: Jul. 29, 1999

(51) Int. Cl.[7] ..... B63B 59/00
(52) U.S. Cl. ..... 114/222
(58) Field of Search ..... 406/124, 38–44; 55/356, 342, 385.1, 429; 114/222; 414/137.9

(56) References Cited

U.S. PATENT DOCUMENTS

| | | | | |
|---|---|---|---|---|
| 323,226 | * | 7/1885 | Smith | 406/39 |
| 4,016,994 | * | 4/1977 | Wurster | 214/508 |
| 4,224,043 | * | 9/1980 | Dupre | 55/319 |

* cited by examiner

*Primary Examiner*—Ed Swinehart
(74) *Attorney, Agent, or Firm*—Stuart M. Goldstein

(57) ABSTRACT

A self-contained floating vessel is configured as a self-propelled or barge-like floating hull. It is equipped with a vacuum exhaust unit configured to pull an air-stream vacuum, by means of pipe and hose lines, from ship cargo holds which contain residual particulate cargo. Primary and secondary collectors are used to separate the particulate cargo from the air-stream. The air-stream with particulate cargo is separated in the first collector by a series of baffles. Approximately ninety-five percent of the residual cargo drops to the bottom of and accumulates within the primary collector, where it is recovered through a dump valve in the collector. The remaining air-stream/particulate cargo mixture is pulled through the secondary collector, which filters and recovers the particulate from the air-stream by means of filters. The cargo particulate is also accumulated in the secondary collector, where it is recovered through a dump valve. The collectors can function within the hull of the self-contained vessel or can be separated from the hull and transported by floating crane or alternate ship or shoreside lifting devices and placed on recovery receptacles, such as cargo bays, cargo barges or positioned over jumbo cargo bays. After the cargo is removed, the vessel cargo holds are washed down to remove traces of cargo, so as to permit loading of new cargo. The waste water is pumped through filters to remove the trace cargo. The filtered water can then be pumped into the ship's ballast tanks or, depending on the cargo, pumped directly overboard.

38 Claims, 4 Drawing Sheets

SELF-CONTAINED SHIP'S HOLD CARGO RECOVERY AND CLEANING VESSEL AND METHOD

BACKGROUND OF THE INVENTION

This invention relates generally to cargo handling and more particularly to recovering dry residual, particulate bulk materials from the holds of ships and the cleaning of these holds.

The need to clean residual bulk particulate cargoes, like cement, petroleum coke (carbon), ash, ores, bauxite, coal, from the holds of ships has been present as long as vessels have been carrying such cargoes; yet an efficient, economical, and environmentally friendly means to accomplish this end, and still recover residual cargoes, has heretofore not been developed. Ships' holds are, to this day, still cleaned by primitive methods, with shovels, scrapers and brooms. On ships without cargo gear, residues of cargoes are hoisted by hand up to the deck in drums. Truck mounted vacuum cleaning systems are widely utilized in shore-based industry, but are considered impractical for ship cleaning for three main reasons. Ships often discharge at an anchorage or at a floating terminal, which are, obviously, inaccessible to trucks. At many docks, truck access is impossible due to the presence of discharge equipment or to obstructions such as pipelines. Finally, some dock facilities are on barges or floats, or are located on piers out in the water, with no truck access.

With the exception of high-pressure water blasting equipment for removal of scale and hardened residues of previous cargoes, which is not a subject of this disclosure, the "technology" of ship hold cleaning has not changed in many years. Ships lose days of valuable time lying idle while cleaning gangs work. A typical Panamax vessel (60,000 deadweight tons) takes a week to clean after discharging a bulk cement cargo. The residue of cargo cleaned is either dumped in a landfill or sold at a reduced price as secondary material.

After discharging the cargo and sweeping out the holds, the final part of the cleaning process consists of washing down the holds. With some dirty cargoes, particularly bulk cement, the ship must then transit out to sea to pump dirty cargo/water slurry over the side, incurring, in some cases, tens of thousands of dollars in expenses to return to the same port. Unscrupulous owners have the dirty water pumped over the side into the port or river. Having water pumps and filters available to purify the dirty water from an in-port washdown would be a great benefit, if the ship were to load her next cargo from the same port. In years past, pumping the dirty water overboard was common practice. It is now forbidden due to environmental restrictions. It is desirable to be able to clean this wash water to permit the ship to load in the same port where it just discharged and to eliminate pollution when this water is discharged.

There are no boat or barge mounted systems in use or in the literature which perform this function. While the disclosure in U.S. Pat. No. 4,016,994 briefly suggests, in passing, that the truck mounted cleaning system could be installed on a boat, it contemplates that this installation would be for the purpose of cleaning oil spills, not the recovery of cargoes and cleaning of hulls. Most significantly, the '994 patent provides nothing other than the bare suggestion of the use of a vessel and, of course, the truck operated system of the patent does not disclose the features of the subject invention.

In the past, ship costs were small and the time for cleaning inconsequential; labor was cheap and readily available, and environmental restrictions were lax or non-existent. With the advent of large ships with long delays in cleaning, progressively higher wage rates, and severe environmental laws and regulations, a vessel recovery system which efficiently and economically recovers residual cargo from holds, while providing environmentally safe cleaning capabilities would be of great benefit to the cargo handling industry.

Accordingly, it is the object of the present invention to provide a self-contained ship's cargo recovery and cleaning vessel which overcomes the limitations and deficiencies of prior vessels.

It is the object of the present invention to provide a self-contained ship's cargo recovery and cleaning vessel which effectively recovers residual particulate cargo from the holds of ships.

It is another object of the present invention to provide a self-contained ship's cargo recovery and cleaning vessel which effectively collects and accumulates residual particulate cargo for delivery to designated cargo receptacles.

It is a further object of the present invention to provide a self-contained ship's cargo recovery and cleaning vessel which effectively and efficiently cleans trace residual particulate cargo from ship holds.

It is still another object of the present invention to provide a self-contained ship's cargo recovery and cleaning vessel which recovers and cleans residual particulate cargo from ship holds by using a system of vacuum exhausters and collectors which can be used on the vessel or are separable from the vessel for use off the vessel.

It is another object of the present invention to provide a self-contained ship's cargo recovery and cleaning vessel which has the capability of washing the holds of ships with water, filtering the water, with the resultant clean water discharged or stored as ballast.

It is still another object of the present invention to provide a self-contained ship's cargo recovery and cleaning vessel which allows a bulk particulate cargo ship to discharge its cargo and then load in the same port, without losing cargo or risking pollution from hold cleaning.

It is a further object of the present invention to provide a self-contained ship's cargo recovery and cleaning vessel which permits flexible off loading of residual particular cargoes and cleaning of ship holds at discharge sites which are inaccessible to land based vehicles.

It is an additional object of the present invention to provide a self-contained ship's cargo recovery and cleaning vessel which provides a recovery and ship's hold cleaning system which is fast and economical, allowing the recovery of substantially all cargo, thus increasing the value of the cargo shipment.

The present invention comprises a self-contained floating vessel which may be self-propelled or barge-like in configuration. It is equipped with a vacuum exhaust unit configured to pull an air-stream vacuum, by means of pipe and hose lines, from ship cargo holds which contain residual particulate cargo. Primary and secondary collectors are used to separate the particulate cargo from the air-stream. The air-stream with particulate cargo is separated in the first collector by a series of baffles. Approximately ninety-five percent of the residual cargo drops to the bottom of and accumulates within the primary collector, where it is recovered through a dump valve in the collector. The remaining air-stream/particulate cargo mixture is pulled through the secondary collector, which filters and recovers the particulate from the air-stream by means of filters. The cargo particulate is also accumulated in the secondary collector, where it is recovered through a dump valve. The collectors can function within the hull of the self-contained vessel or can be separated from the hull and transported by floating crane or alternate ship or shoreside lifting devices and placed on recovery receptacles, such as cargo bays, cargo barges or positioned over jumbo cargo bays.

After the cargo is removed, the vessel cargo holds are washed down to remove traces of cargo, so as to permit loading of new cargo. The waste water is pumped through filters to remove the trace cargo. The filtered water can then be pumped into the ship's ballast tanks or, depending on the cargo, pumped directly overboard.

The novel features which are considered as characteristic of the invention are set forth in particular in the appended claims. The invention, itself, both as to its design, construction, and use, together with additional features and advantages thereof, are best understood upon review of the following detailed description with reference to the accompanying drawings.

DETAILED DESCRIPTION OF THE INVENTION

Figure 1:
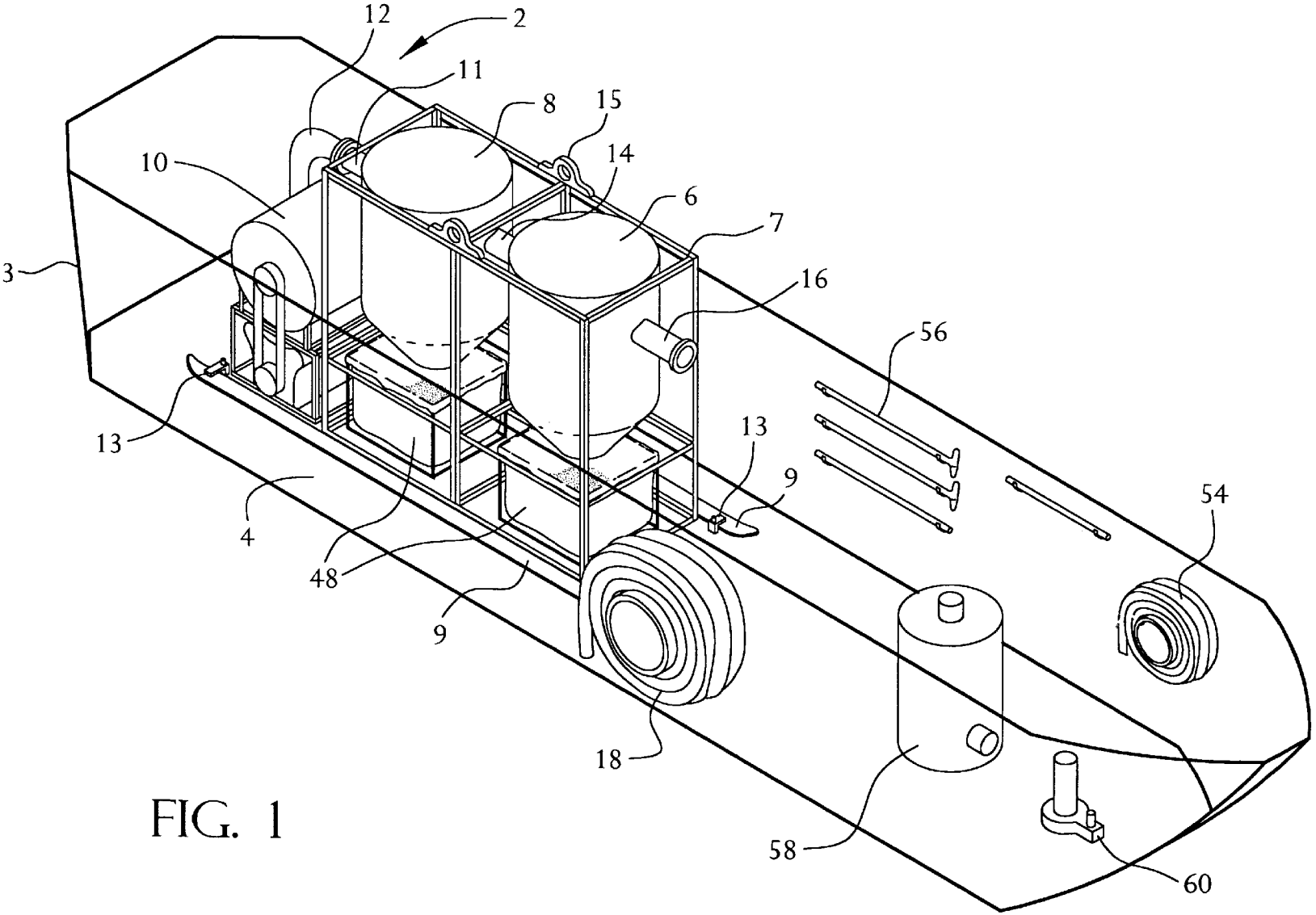
FIG. 1 is a modified perspective view showing the components of the basic self-contained vessel of the invention and their respective locations within the vessel's hull.

The self-contained vessel 2 of the present invention comprises floatable hull 3 with deck 4. Hull 3 houses primary particulate cargo collector 6, secondary particulate cargo collector 8, and vacuum exhauster 10. Depending on cost and availability of labor in the port, these hull components can be installed on either a work-boat or a barge. A boat, having its own engine, would permit independent operation of the vessel unit without the need for a tugboat, which would be required if the components were barge mounted.

Piping 12 runs from vacuum exhauster 10 to secondary collector 8, via piping 11. Piping 14 runs from secondary collector 8 to primary collector 6. Piping 16 runs from primary collector 6 and is secured to flexible hose 18. Hose 18 runs to particulate cargo vessel 20 and hold 22, to be cleaned. Collectors 6 and 8 are supported by framing 7 which is secured to collector deck supports 9. Clamps 13 secure supports 9 to deck 4 of hull 3.

Primary collector 6 consists of cylinder 24 with an elongated vertical axis. Piping 16 enters the upper section of cylinder 24 and piping 14 exits the cylinder for connection to the upper section of cylinder 26 of secondary collector 8. Cylinder 24 contains baffles 28 and a lower chamber 30. Dump valve 32 is located on the bottom of cylinder 24.

Cylinder 26 of secondary collector 8 contains a filter system consisting of one or more filter bags 34, extending from the top of cylinder 26. Secondary collector 8 also has lower chamber 36 and dump valve 37.

Piping 11 and 12 runs from secondary collector 8 to vacuum exhauster 10. It is contemplated that vacuum exhauster 10 produces vacuum, suction force air-stream 38 by means of a diesel driven centrifugal exhauster. Diesel power is preferred over gasoline for safety reasons. In a boat mounted system, it would be possible to use the boat's engine to run the exhauster; but for reasons of flexibility, a second engine could be installed. At shoreside terminals where vacuum discharge equipment is available, such equipment could be connected to create the vacuum from shoreside.

Figure 2:
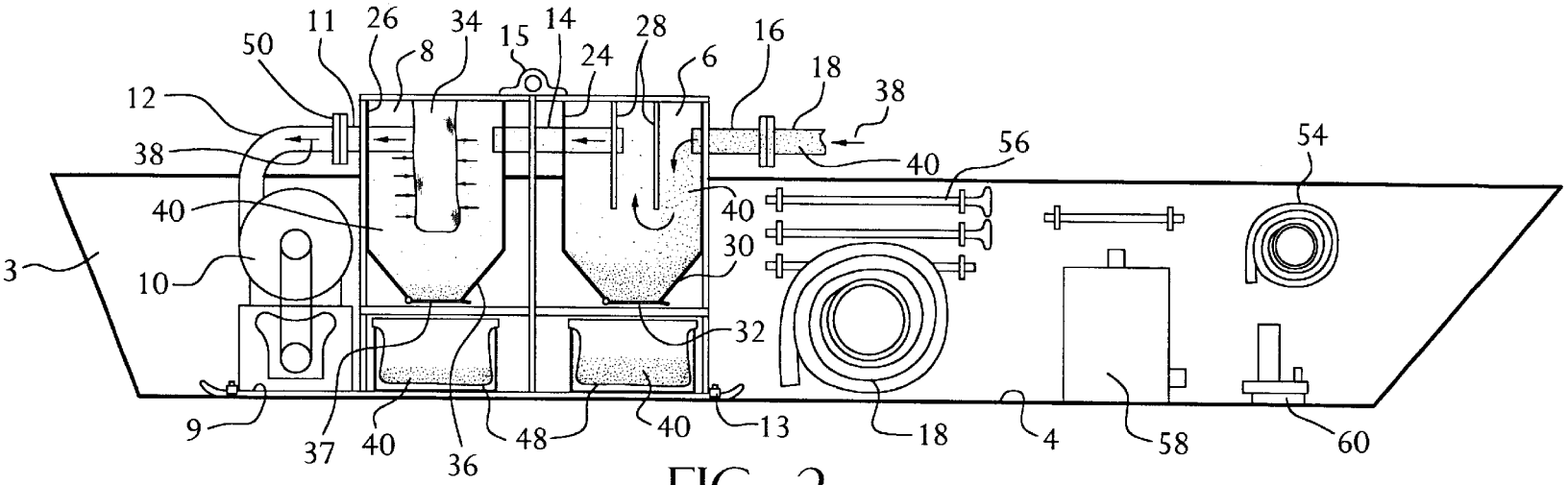
FIG. 2 is a side view of the self-contained vessel of the invention, while in operation.
Figure 3:
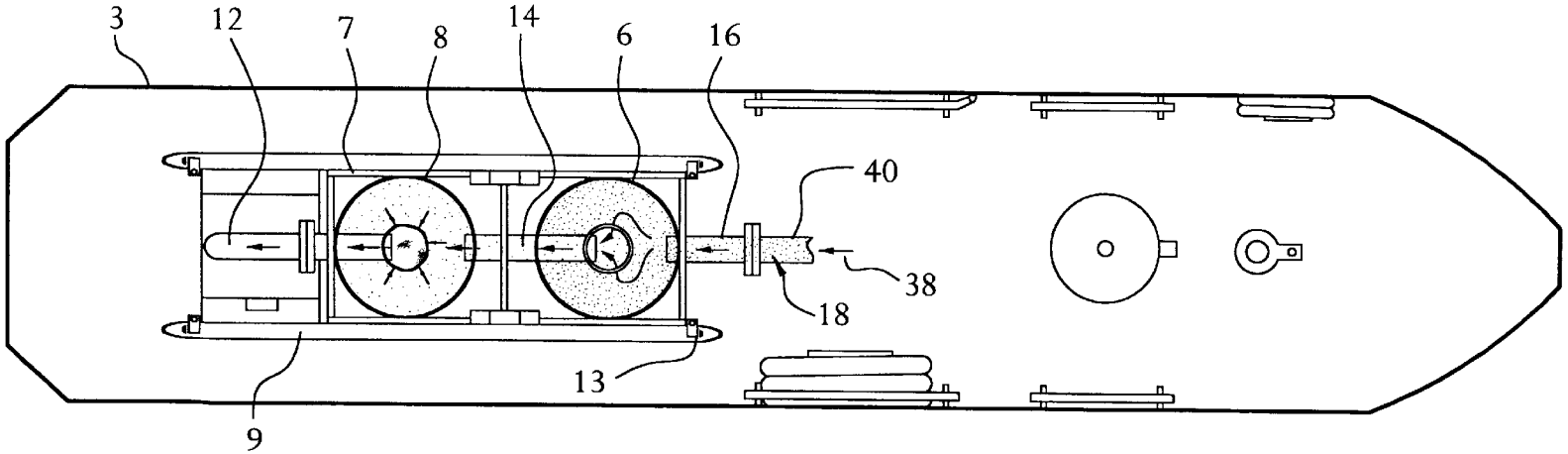
FIG. 3 is a top view of the self-contained vessel of the invention, while in operation.
Figure 4:
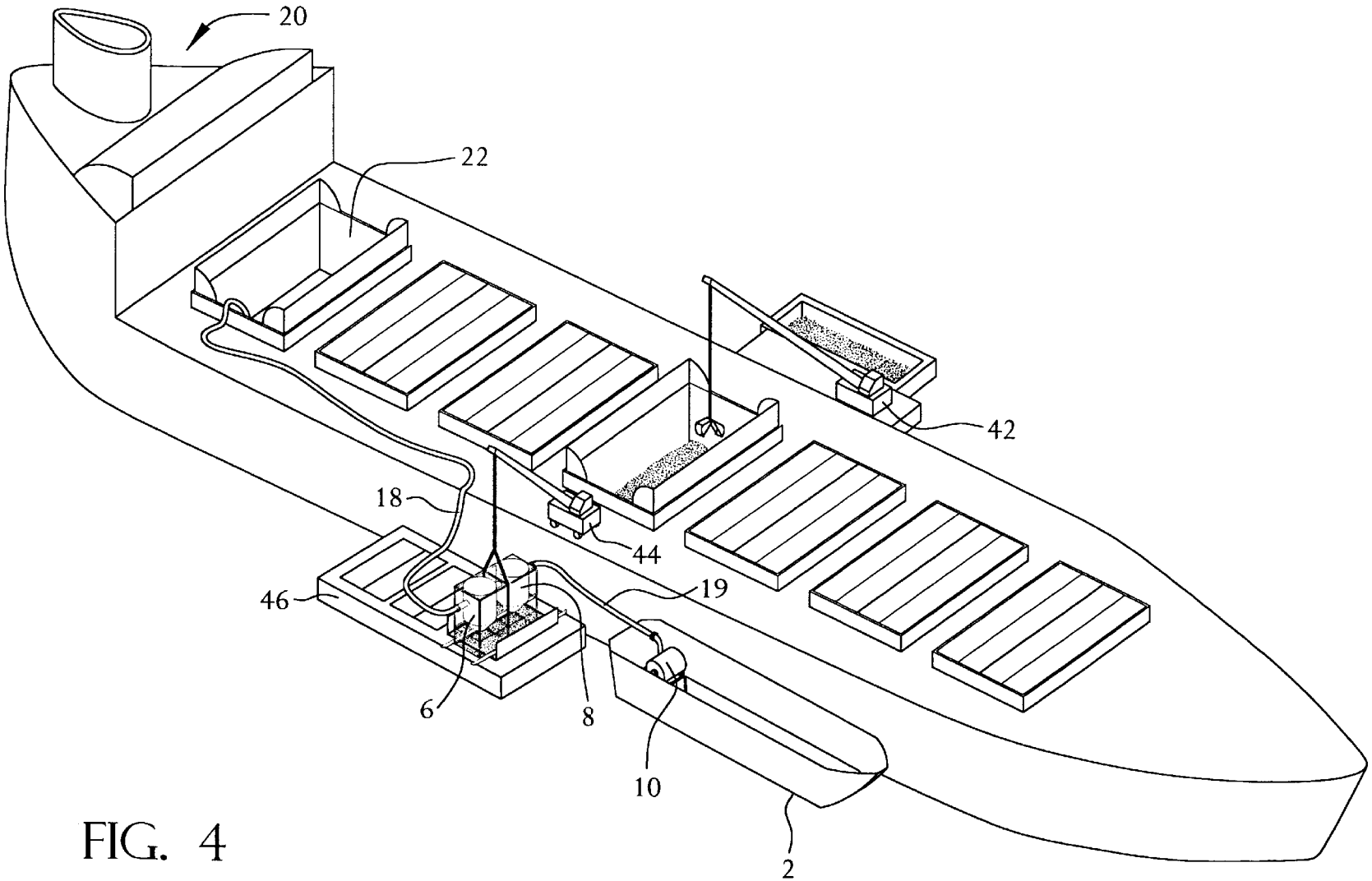
FIG. 4 is a view of the relative positions of the self-contained vessel of the subject invention and a ship which is being unloaded.

In operation, vessel 2 would be positioned alongside cargo vessel 20 being discharged, for instance, as shown in FIG. 4. After the first hold has been substantially emptied of its particulate cargo and the standard discharge equipment removed, the cargo recovery and hold cleaning operation would commence. One of the primary goals of this operation is to deliver particulate cargo residues (as much as one-half to one percent of the total cargo) to the mass of discharged cargo, rather than have it wasted or disposed of as secondary materials. This is accomplished by placing hose 18 into hold 22. Vacuum exhauster 10 is operated, as shown in FIGS. 2 and 3, to produce vacuum/suction air-stream 38 which draws particulate cargo 40 through hose 18 and piping 16, into primary collector 6. Baffles 28 direct t relatively heavy particulate cargo 40 downward, where most of the material drops out of air-stream 38 and is collected in lower chamber 30 of collector 6. It is contemplated that in excess of ninety-five percent of particulate cargo 40 in air-stream 38 will be removed in primary collector 6.

The remaining air-stream/particulate cargo mixture is then drawn through piping 14 into secondary collector 8, where the remaining cargo 40 is separated from air-stream 38 by filter bags 34. This residue of cargo 40 drops into lower chamber 36.

Although two collectors are disclosed, it is contemplated that multiple collectors may be employed, depending on the cargo and the type of collector use. There are a variety of such collectors or separators on the market, each with varying configurations and filtering capabilities. As a result, more than two collector units may be required or used.

Collectors 6 and 8 can be detached and separated from hull 3 by disconnection of flange connection 50, which normally secures piping 11 and 12, and by releasing clamps 13 securing collection deck supports 9. It can then be appreciated that the entire collection assembly, including collectors 6 and 8, framing 7, deck supports 9, and piping 11, 14, and 16, can then be lifted free from hull 3 via lifting eyes 15, by conventional lifting means, like a floating crane 42. Equipment at the discharge terminal is also usually available for hoisting collectors 6 and 8 up to and down from the ship being cleaned. In the case of handy and handy-max vessels, ship's gear is usually available. At terminals with vacuum or mechanical screw conveyor systems, there is often equipment with some lifting capability. However, should there be no equipment available, or should the equipment be employed in the discharge operations, a movable davit and chain hoist 44 are supplied to permit the cleaning crew to move collectors and other equipment to and from the ship and in and out of the holds.

Collectors 6 and 8 can be transported and positioned by the lifting means over the last hold or cargo bay of discharging vessel 20. By opening dump valve 32 of collector 6 and dump valve 37 of collector 8, the residual collected cargo 40 is returned to the main cargo stream.

It is advantageously contemplated that, for efficiency of operation, collectors 6 and 8 could be positioned over the last hold to be discharged during the on-going particulate cargo separation process. In this case, when hold 22 is completely emptied of residual cargo, dump valves 32 and 37 of collectors 6 and 8 respectively, can simply be opened or remain open during the process, to deliver residual cargo 40 to the last cargo hold or bay of vessel 20.

Alternatively, where cargo 40 is to be discharged into a barge 46, as shown in FIG. 4, collectors 6 and 8 could be positioned over a hatch of the barge, so that upon completion of recovery/cleaning operations, the barge could directly receive the cargo. In such a case and generally when collectors 6 and 8 are detached for use from vessel 2, an additional flexible hose 19 is secured between collector 8 and vacuum exhaust 10.

Final cleaning of vessel 20 may require that collectors 6 and 8 be positioned over jumbo cargo bags 48 located on hull 3, to receive cargo from the last vessel hold to be emptied, as shown in FIGS. 1–3. Of course when bags 48 are not in place. Particular cargo 40 accumulated in collectors 6 and 8 can be discharged directly to barge or ship's holds via dump valves 32 and 37.

Figure 5:
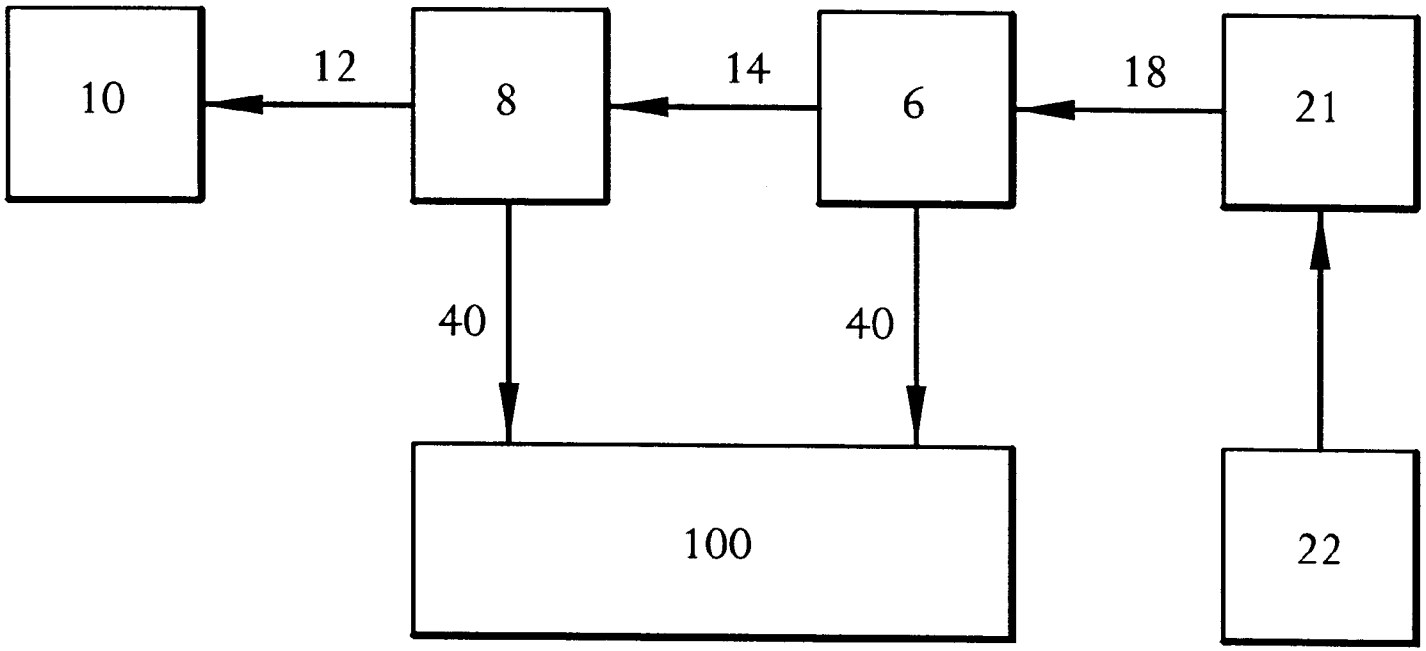
FIG. 5 is a schematic representation of the basic operation of the invention.

FIG. 5 shows a schematic representation of the basic operation of the system contemplated by the self-contained floating vessel of this invention. Vacuum exhauster 10 creates an air-stream which, by suction, draws residual particular cargo from ship's hold 22 by means of standard collection tools and equipment 21 connected, for instance, to hose 18 in the hold. The air-stream is then drawn through primary collector 6, through piping 14 and into secondary collector 8, via piping 12. Cargo resides 40 from collectors 6 and 8 are accumulated in receptacle 100, which may be a barge, cargo hold, cargo bays, cargo bags or like storage containers.

After the residual cargo has been removed by the apparatus and process described, a separate cleaning crew, working independently or alongside vessel crew, vacuums the slight cargo traces remaining on hold bulkhead and deck surfaces, using commercially available vacuum and cleaning equipment, such as ladders, shovels, and brooms.

After removal of all cargo residues, the holds must still be washed down to complete the discharge process and to remove traces of cargo, so that new and subsequent cargoes can be loaded. When commencing this phase of the operation, the cleaning crew would begin the wash-down using water from the ship or the harbor. Water hose 54 and cleaning tools 56 located on vessel 2 would be used in this cleaning and wash-down process. Rather than pumping the cargo/water slurry from the holds into the ballast tanks, where cargo residue could plug up piping systems, it would be pumped through filter 58 to remove the cargo. Water so filtered would first be used for the washing process; and after that job was completed, it would be capable of being stored in the ships' ballast tanks for discharge later or, for some cargoes, pumped directly over the side in port. Sump pump 60 is provided for excess water discharge.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

What is claimed is:

1. A self-contained floating vessel for cleaning a ship cargo hold containing residual dry bulk particulate cargo, comprising:

(a) a floatable hull;

(b) particulate cargo collector means for accepting the residual particulate cargo from the ship's hold, said collector means being operable on the vessel and being separable from and independently transportable for use off the vessel;

(c) means to detachably secure the collector means to the hull to permit its transport and use off the vessel and its reinstallation on the vessel;

(d) vacuum exhaust means permanently affixed to the vessel, said vacuum exhaust means producing a vacuum air-stream which draws the residual particulate cargo out of the hold and through the collector means, whereby the collector means then separates the particulate cargo from the air-stream and accumulates the separated cargo;

(e) transfer means interconnecting the vacuum exhaust means, the collector means, and the hold, for the free flow of residual particulate cargo between the hold and collector means, and the vacuum exhaust means.

2. The self-contained floating vessel as described in claim 1 in which the collector means comprises a primary collector which accepts the residual particulate cargo in the air-stream and separates the majority of the cargo from the air-stream, the cargo dropped out of the air-stream and accumulating in the primary collector and the air-stream being directed out of the primary collector.

3. The self-contained floating vessel is described in claim 2 in which the first collector comprises baffling means for separating the residual particulate cargo from the air-stream by directing the cargo downward into the first collector and the air-stream upward, out of the collector.

4. The self-contained floating vessel as described in claim 2 in which the primary collector removes in excess of ninety-five percent of the particulate cargo from the air-stream.

5. The self-contained floating vessel as described in claim 2 in which the collector means further comprises a secondary collector which accepts the remaining residual particulate cargo in the air-stream which has not been separated by the primary collector and separates this remaining cargo from the air-stream for accumulation of the cargo in the secondary collector.

6. The self-contained floating vessel as described in claim 5 in which the secondary collector comprises filter means to separate the remaining residual particulate cargo from the air-stream.

7. The self-contained floating vessel as described in claim 1 in which the collector means comprises a primary collector for separating the majority of the residual particulate cargo from the air-stream and accumulating that cargo in the primary collector and a secondary collector for separating cargo from the air-stream and accumulating the remaining cargo in the secondary collector.

8. The self-contained floating vessel as described in claim 1 in which the collector means is secured within the hull of the vessel while it is operably separating the particulate cargo from the air-stream.

9. The self-contained floating vessel as described in claim 8 in which the collector means accumulates the particulate cargo in and directs the air-stream out of the collector means.

10. The self-contained floating vessel as described in claim 9 in which the collector means comprises means to deliver the accumulated cargo to a separate cargo receptacle.

11. The self-contained floating vessel as described in claim 10 in which the collector means is transportable from the hull to the cargo receptacle.

12. The self-contained floating vessel as described in claim 10 in which the means to deliver the accumulated cargo comprises a dump valve in the collector means.

13. The self-contained floating vessel as described in claim 10 in which the cargo receptacle is a cargo barge.

14. The self-contained floating vessel as described in claim 10 in which the cargo receptacle is a cargo bay.

15. The self-contained floating vessel as described in claim 1 in which the means to detachably secure the collector comprises collector deck supports detachably secured by clamp connections.

16. The self-contained floating vessel as described in claim 1 in which the transfer means comprises a system of pipe and hose lines running between the vacuum exhaust means, the collector means, and the hold.

17. A self-contained floating vessel for cleaning a ship hold carrying residual dry bulk particulate cargo, said vessel comprising:

(a) a floatable hull;

(b) a primary particulate cargo collector unit detachably secured to the hull, said primary collector being operable on the vessel and being separable from and transportable for use off the vessel;

(c) a secondary particulate cargo collector unit detachably secured to the hull, said secondary collector being operable on the vessel and being separable from and transportable for use off the vessel;

(d) means to detachably secure the primary and secondary collector units to the hull to permit its transport and use off the vessel and its reinstallation on the vessel;

(e) a vacuum exhauster affixed to the hull for drawing an air-stream containing particulate cargo from the hold, through the primary collector, and then through the secondary collector;

(f) air-stream lines interconnecting the hold, the vacuum exhauster, and the primary and secondary collector means.

18. The self-contained floating vessel as described in claim 17 in which the primary collector comprises a system of baffles which directs particulate cargo downward into the primary collector and the air-stream upward out of the primary collector.

19. The self-contained floating vessel as described in claim 17 in which the secondary collector comprises a particulate cargo filter.

20. The self contained floating vessel as described in claim 17 in which the means to detachably secure the primary and secondary collectors comprise deck supports and clamp connections which permit the collectors to be separated from the vessel and reinstalled on the vessel.

21. The self-contained floating vessel as described in claim 17 in which the air-stream lines are flexibly configured to permit transport and flexible use of the primary and secondary collectors while they are off the vessel.

22. A method of cleaning a ship cargo hold containing residual dry bulk particulate cargo comprising the steps of:

(a) providing a floatable hull with vacuum exhaust means which draws an air-stream, particulate cargo collector means for accepting particulate cargo, and transfer lines for transporting particulate cargo and the air-stream;

(b) situating the hull with the vacuum exhaust means and the collector means in close proximity to the hold;

(c) positioning the transfer lines between the hold and the collector means, and the collector means and the vacuum exhaust means;

(d) separating the collector means from the hull and positioning the collector means on the cargo recovery receptacle;

(e) by means of a suction force applied by the vacuum exhaust means, creating a moving air-stream through the transfer lines after the collection means is separated from the hull and it is positioned on the cargo recovery receptacle;

(f) removing the particulate cargo from the hold by drawing the cargo into the suction created by the air-stream;

(g) drawing the air-stream with particulate cargo through the transfer lines to the collector means;

(h) separating the particulate cargo from the air-stream in the collector means;

(i) accumulating the recovered particulate cargo in the collector means;

(j) delivering the particulate cargo to a cargo recovery receptacle.

23. The method of cleaning a ship cargo hold as described in claim 22 including the additional step of separating remaining particulate cargo from the air-stream in a secondary collector, after the air-stream with particulate has passed through the collector means.

24. The method of cleaning a ship cargo hold as described in claim 22 in which the particulate cargo is separated from the air-stream by a series of baffles in the collector means.

25. The method of cleaning a ship cargo hold as described in claim 22 including the additional step of vacuuming up cargo residues in the hold.

26. The method of cleaning a ship cargo hold as described in claim 25 including the additional step of washing down the hold with water and pumping the resulting particulate cargo/water slurry through filter means to remove the cargo.

27. The method of cleaning a ship cargo hold as described in claim 26 including the additional steps of recovering the particulate cargo from the cargo/water slurry and discharging the water.

28. The method of cleaning a ship cargo hold as described in claim 22 in the collector means is positioned on the cargo receptacle by a floating crane.

29. The method of cleaning a ship cargo hold as described in claim 22 in the collector means is positioned on the cargo receptacle by lifting equipment.

30. A self-contained floating vessel for cleaning a ship cargo hold containing residual dry bulk particulate cargo, comprising:

(a) a floatable hull;

(b) particulate cargo collector means for accepting the residual particulate cargo from the ship's hold, said collector means being operable on the vessel and being separate from and independently transportable for use off the vessel;

(c) vacuum exhaust means permanently affixed to the vessel, said vacuum exhaust means producing a vacuum air-stream which draws the residual particulate cargo out of the hold and through the collector means, whereby the collector means separates the particulate cargo from the air-stream and accumulates the separated cargo, the collector means being physically located off of the hull of the vessel while it is operably separating the particulate cargo from the air-stream;

(d) transfer means interconnecting the vacuum exhaust means, the collector means, and the hold, for the free flow of residual particulate cargo between the hold and collector means, and the vacuum exhaust means.

31. The self-contained floating vessel as described in claim 30 wherein the collector means is located on a separate cargo receptacle.

32. The self-contained floating vessel as described in claim 30 in which the collector means accumulates the particulate cargo in and directs the air-stream out of the collector means.

33. The self-contained floating vessel as described in claim 32 in which the collector means comprises means to deliver the accumulated cargo to a cargo receptacle.

34. The self-contained floating vessel as described in claim 33 in which the means to deliver the accumulated cargo comprises a dump valve in the collector means.

35. The self-contained floating vessel as described in claim 33 in which the cargo receptacle is a cargo barge.

36. A method of cleaning a ship cargo hold containing residual dry bulk particulate cargo comprising the steps of:

(a) providing a floatable hull with vacuum exhaust means which draws an air-stream, particulate cargo collector means for accepting particulate cargo, and transfer lines for transporting particulate cargo and the air-stream;

(b) situating the hull with the vacuum exhaust means and the collector means in close proximity to the hold;

(c) positioning the transfer lines between the hold and the collector means, and the collector means and the vacuum exhaust means;

(d) by means of a suction force applied by the vacuum exhaust means, creating a moving air-stream through the transfer lines, (e) removing the particulate cargo from the hold by drawing the cargo into the suction created by the air-stream;

(f) drawing the air-stream with particulate cargo through the transfer lines to the collector means;

(g) separating the particulate cargo from the air-stream in the collector means;

(h) accumulating the recovered particulate cargo in the collector means;

(i) after accumulating the recovered particulate, separating the collector means from the hull and positioning it on the cargo recovery receptacle; and (j) delivering the particulate cargo to the cargo recovery receptacle.

37. The method of cleaning a ship cargo hold as described in claim 36 in which the collector means is positioned on the cargo receptacle by a floating crane.

38. The method of cleaning a ship cargo hold as described in claim 36 in which the collector means is positioned on the cargo receptacle by lifting equipment.

* * * * *